United States Patent [19]

Sato et al.

[11] Patent Number: 4,611,937

[45] Date of Patent: Sep. 16, 1986

[54] RIBBON FEED MECHANISM FOR A PRINTER

[75] Inventors: Yoshiaki Sato; Osamu Takahashi, both of Kashiwazaki, Japan

[73] Assignee: Silver Seiko Ltd., Kashiwazaki, Japan

[21] Appl. No.: 570,637

[22] Filed: Jan. 13, 1984

[30] Foreign Application Priority Data

Jan. 19, 1983 [JP] Japan ..... 58-5797

[51] Int. Cl.[4] ..... B41J 32/00

[52] U.S. Cl. ..... 400/208; 400/120; 400/225; 400/229; 400/233; 400/234; 400/236

[58] Field of Search ..... 400/120, 185, 194, 195, 400/196, 196.1, 207, 208, 208.1, 222, 225, 229, 231, 233, 234, 320, 322, 335, 236; 192/12 BA, 41 S; 346/76 PH

[56] References Cited

U.S. PATENT DOCUMENTS

| | | | |
|---|---|---|---|
| 3,793,951 | 2/1974 | Denley | 400/194 X |
| 3,841,459 | 10/1974 | Buschmann et al. | 400/229 X |
| 3,855,448 | 12/1974 | Hanagata et al. | 346/76 PH X |
| 3,939,957 | 2/1976 | Bittner | 400/222 X |
| 4,047,607 | 9/1977 | Willcox | 400/229 X |
| 4,300,847 | 11/1981 | Hoffman et al. | 400/320 X |
| 4,350,452 | 9/1982 | Dials et al. | 400/229 X |
| 4,376,586 | 3/1983 | Fujisawa | 400/229 |
| 4,378,566 | 3/1983 | Tsukamura | 400/234 X |
| 4,420,268 | 12/1983 | Tsukamura et al. | 400/233 |
| 4,422,786 | 12/1983 | Piptone | 400/208 X |
| 4,456,392 | 6/1984 | Nozaki et al. | 400/229 X |
| 4,468,139 | 8/1984 | Hattori | 400/120 |

FOREIGN PATENT DOCUMENTS

| | | | |
|---|---|---|---|
| 0205185 | 12/1982 | Japan | 400/236 |

OTHER PUBLICATIONS

IBM Technical Disclosure Bulletin, "Clutch-Brake Device", Vail, Jr., vol. 9, No. 9, Feb. 1967, p. 1184.

*Primary Examiner*—Ernest T. Wright, Jr.
*Attorney, Agent, or Firm*—Ziems, Walter & Shannon

[57] ABSTRACT

A printer having a print ribbon feed mechanism is disclosed which allows optimal feeding of a print ribbon, eliminating unnecessary consumption of the ribbon. The mechanism includes first and second clamp means mounted on a stationary section and a print carrier of the machine, respectively, which are both controlled in accordance with movement of a print head from and to a print enabling position. Means are provided which are connected to a carrier indexing mechanism for impositively driving print ribbon supply and takeup spools disposed on the stationary section to wind a print ribbon onto them during a carrier return operation whereas they allow the ribbon to be unwound from the ribbon spools when the carrier advances.

19 Claims, 6 Drawing Figures

RIBBON FEED MECHANISM FOR A PRINTER

BACKGROUND OF THE INVENTION

This invention relates to a printer or typewriter, and more particularly to a printer or typewriter in which a ribbon supply is mounted on a stationary section of the machine and a print ribbon is passed through a print head on a carrier and is fed in relation to movement of the carrier.

In a printer or typewriter of the type described, and especially in a thermal printer or typewriter which has a thermal print head on a carrier, a print ribbon such as a ribbon having thermally transferrable ink thereon is fed an extent corresponding to a distance of and in a direction opposite to the direction of translatory movement of the carriage as the carriage advances to print a line of characters on a medium supported on a platen, or in other words, a print ribbon is fed in such a manner as to provide no relative movement between the medium and the print ribbon. If otherwise there is some relative movement between them, then ink once transferred to the medium will be diffused over the medium due to such relative movement and will blur the medium, resulting in poor print. A print ribbon feeding mechanism which attains such a print ribbon feeding manner as described just above is disclosed in a U.S. Pat. No. 3,855,448 and especially by an embodiment of FIG. 5 of the patent. This mechanism includes a clamp provided at a stationary section of the machine for clamping a used portion of a print ribbon while a print head is advancing, and a one-way roller provided on the carrier which allows the print ribbon to pass the same when the carrier advances but prevents the ribbon from passing in the opposite direction so that it draws out the ribbon from a supply reel when the carrier is returned to its leftmost end position while the ribbon is wound onto a takeup reel correspondingly. This arrangement, however, is somewhat disadvantageous in that a print ribbon is "fed" wastefully even when a carriage advances without printing any character, that is, without using the print ribbon, such as in a spacing or tabbing operation, since the print ribbon is fed an extent equal to a distance over which the carrier advances. Further, if a takeup reel is not appropriately driven to takeup a print ribbon in timed relationship with returning movement of the carrier in any position of the reel, then the ribbon may be either pulled so heavily to break or slackened between the takeup reel and the one-way roller to cause jamming. The patent, however, does not disclose any solution to this problem.

SUMMARY OF THE INVENTION

It is an object of the present invention to provide a printer having a print ribbon feed mechanism which provides a solution to such problems of conventional ribbon feed mechanisms and allows optimal feeding of a print ribbon, eliminating unnecessary consumption of the print ribbon.

It is another object of the invention to provide a new and efficient thermal ink transfer ribbon feed mechanism which can be advantageously employed in a thermal ink transfer printer in which a thermal transfer ink ribbon is used.

Other objects, advantages and features of the present invention will become apparent from the following detailed description of a preferred embodiment of the invention given in conjunction with the accompanying drawings.

DETAILED DESCRIPTION OF THE PREFERRED EMBODIMENT

Figure 1:
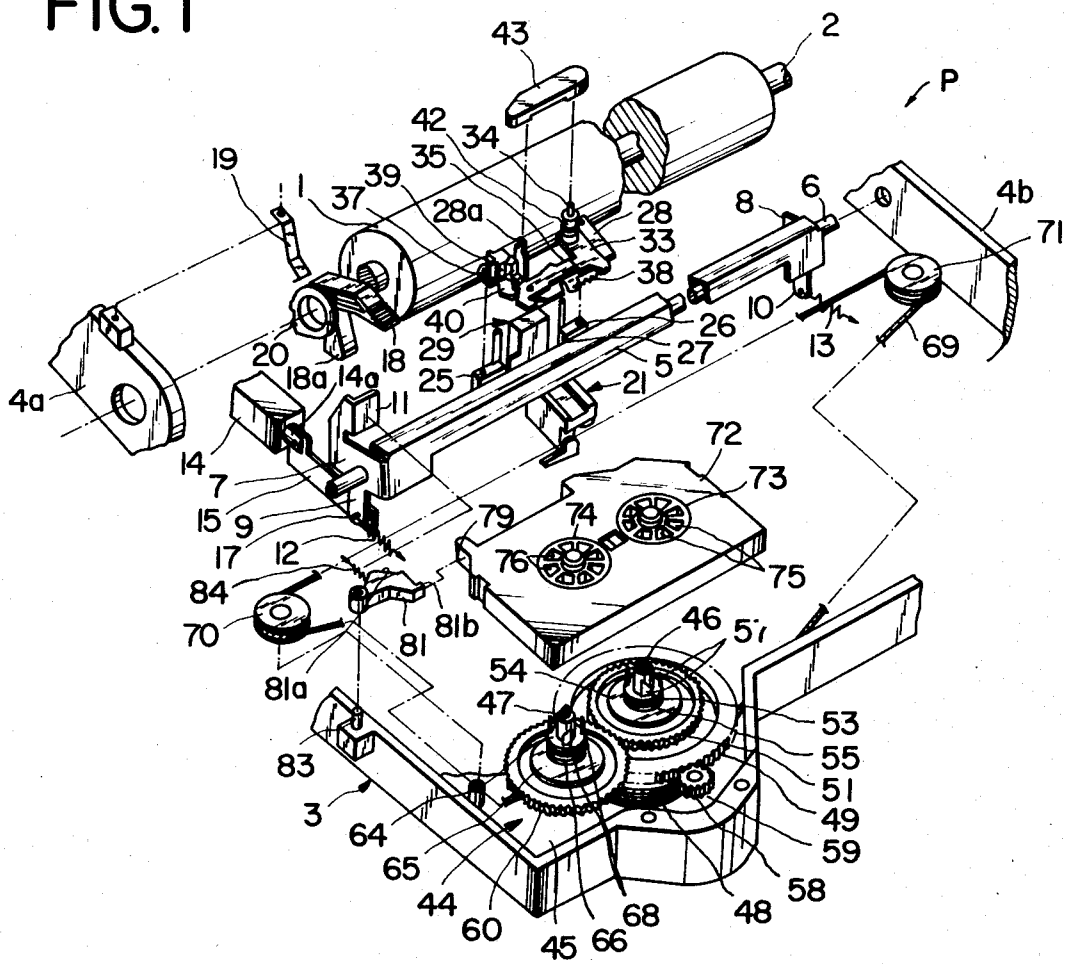
FIG. 1 is a partly cutaway exploded perspective view of part of a printer according to the present invention.

Referring to FIG. 1, a printer, indicated generally by the reference character P, includes a platen 1 extending horizontally between and supported at its opposite ends thereof on left and right side walls 4*a* and 4*b* of a frame 3 (partially illustrated for reasons of clarity) or stationary section of the printer P. A transverse operating bail 5 is rotatably supported on and extends across a major length of a rod 6 which extends in front of and in parallel relationship to the platen 1 between the side walls 4*a* and 4*b*. The operating bail 5 has bearing portions 7 and 8 at its opposite ends thereof at which it is supported on the rod 6. The bearing portion 7 has a lower lug 9 and an upper bent lug 11 formed on the lower and upper sides thereof, respectively. Tension springs 12 and 13 are connected to the spring hanger lugs 9 and 10, respectively, to urge the operating bail 5 counterclockwise about the rod 6. A pin 17 is secured to the lower lug 9 of the operating bail 5 and is received in an arcuate slot 16 formed in a forward end portion of a link 15 which is pivotally connected to the forward end of a plunger 14*a* of a solenoid 14. Thus, if the solenoid 14 is energized, the link 15 will be pulled back to rotate the operating bail 5 clockwise about the rod 6 against the urging of the springs 12 and 13.

A manually operable level 18 is supported for pivotal motion on a left end portion of a shaft 2 of the platen 1 and has a lower extension portion 18*a* which is positioned adjacent the bent lug 11 of the operating bail 5. A leaf spring 19 is secured to the side wall 4*a* and is resiliently abutted against a circumferential projection 20 formed on a bearing portion of the lever 18 to retain the lever 18 in any of its angular positions around the platen shaft 2. In one of the angular positions of the lever 18, the lower extension 18*a* is spaced from the bent lug 11 of the operating bail 5, and if the lever 18 is then turned counterclockwise in FIG. 2, the lower extension 18*a* of the lever 18 will be engaged to press the bent lug 11 to pivot the operating bail 5 clockwise against the springs 12 and 13.

Figure 2:
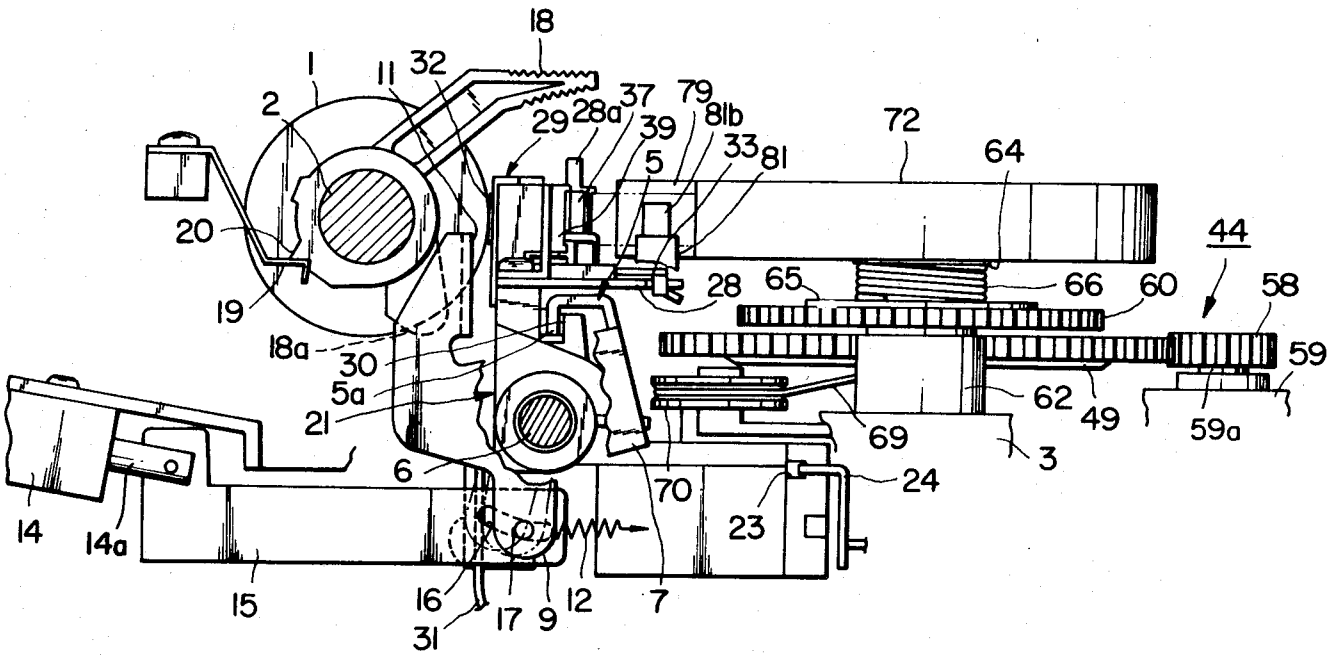
FIG. 2 is an enlarged left-hand side elevational view, partly in section, of the printer of FIG. 1.

A carrier 21 is supported at a lower rear portion thereof for sliding motion on the rod 6. The carrier 21 is substantially in L-shape in side view and has a recess 23 formed at a front end portion thereof (FIG. 2). A linear encoder 24 extends through the recess 23 of the carrier 21 between the side walls 4*a*, 4*b* of the frame 3. A support plate 28 of a substantially U-shape in plan is screwed to the carrier 21 and extends over a recess 27 formed between a pair of riser portions 25 and 26 at opposite lateral ends of a rear end portion of the carrier 21 as shown in FIG. 1, and an upstanding post 28*a* is provided on the left side of the support plate 21. A cap 43 is mounted, at its left end, on the remote end of the upstanding post 28*a* and, at its right end, on the upper end of a pin 34, designated more fully below.

A thermal print head 29 of a substantially rectangular shape in front elevation is supported at a lower end thereof for sliding motion on and for pivotal motion about the rod 6 and is located in position within the recess 27 of the carrier 21 so as to allow integral lateral movement thereof with the carrier 21 along the rod 6. The print head 29 has a column of heater or thermal elements (not shown) mounted thereon and electrically connected to a signal source (not shown) so as to be selectively energized to heat to allow ink to be transferred from a print ribbon 32 to a medium (not shown) supported on the platen 1 to effect printing of a character, as hereinafter described. The structure and configuration of the thermal elements and signal source for selectively energizing the thermal elements are well known in the art. A lateral slit 30 is formed in a portion of the print head 29 adjacent the riser portions 25, 26 of the carrier 21 and a downwardly bent rear marginal edge 5*a* of the operating bail 5 extends through the slit 30 of the print head 29 so as to allow the print head 29 to be pivoted back and forth about the rod 6 by the operating bail 5. A flexible flat cable 31 is connected to the print head 29 to provide for energization of the thermal elements on the print head 29.

Referring now to FIG. 2, when the lever 18 is its forwardmost position, as seen in FIG. 2, and the solenoid 14 is not energized, the operating bail 5 assumes, under the urging of the springs 12, 13, a position in which the print head 29 is resiliently pressed against the platen 1 as seen also from FIG. 5 (this position of the print head 29 will be hereinafter referred to as an "operative position"). In the operative position, the print head 29 can effect printing as hereinafter described. If, on one hand, the solenoid 14 is energized, then the link 15 will be pulled back against the the springs 12, 13 to pivot the carrier 21 clockwise about the rod 6 thereby to pivot the print head 29 in the same direction away from the platen 1 (this pivoted position of the print head 29 will be hereinafter referred to as a "first inoperative position). In the first inoperative position of the print head 29, printing operation cannot be effected actually. On the other hand, if the lever 18 is manually pivoted counterclockwise about the platen shaft 2, then the operating bail 5 will be pivoted clockwise about the rod 6 to pivot the print head 29, e.g., to the first inoperative position. The leaf spring 19, acting on the projection 20 of the lever 18, will retain the lever 18 and hence the print head 29 in the pivoted position and the first inoperative position, respectively. If the lever 18 is pivoted further in the same direction, then the print head 29 will be further pivoted away from the platen 1 to an allowable limit position (this position is indicated by phantom in FIG. 5 and will be hereinafter referred to as a "second inoperative position").

A lever 33 is located on the support plate 28 of the carrier 21 and is mounted at the right rear end 28*c* thereof for pivotal motion on a pin 34 on the support plate 28. The lever 33 has a projection 35 formed at the center of a rear marginal edge 33*b* thereof. A friction member 37 made of a frictional substance such as rubber is secured to a finger 36 formed at a left rear end portion of the lever 33. The lever 33 is urged to pivot in a clockwise direction in FIG. 4 about the pin 34 by a tension spring 38 so as to press the friction member 37 thereon against a guide member 39 secured to the left rear end 28*b* of the support plate 28. In this position of the friction member 37 and/or the lever 33, which will be hereinafter referred to as a "clamping position", a print ribbon 32 is normally clamped between the friction member 37 and the guide member 39.

Figure 4:
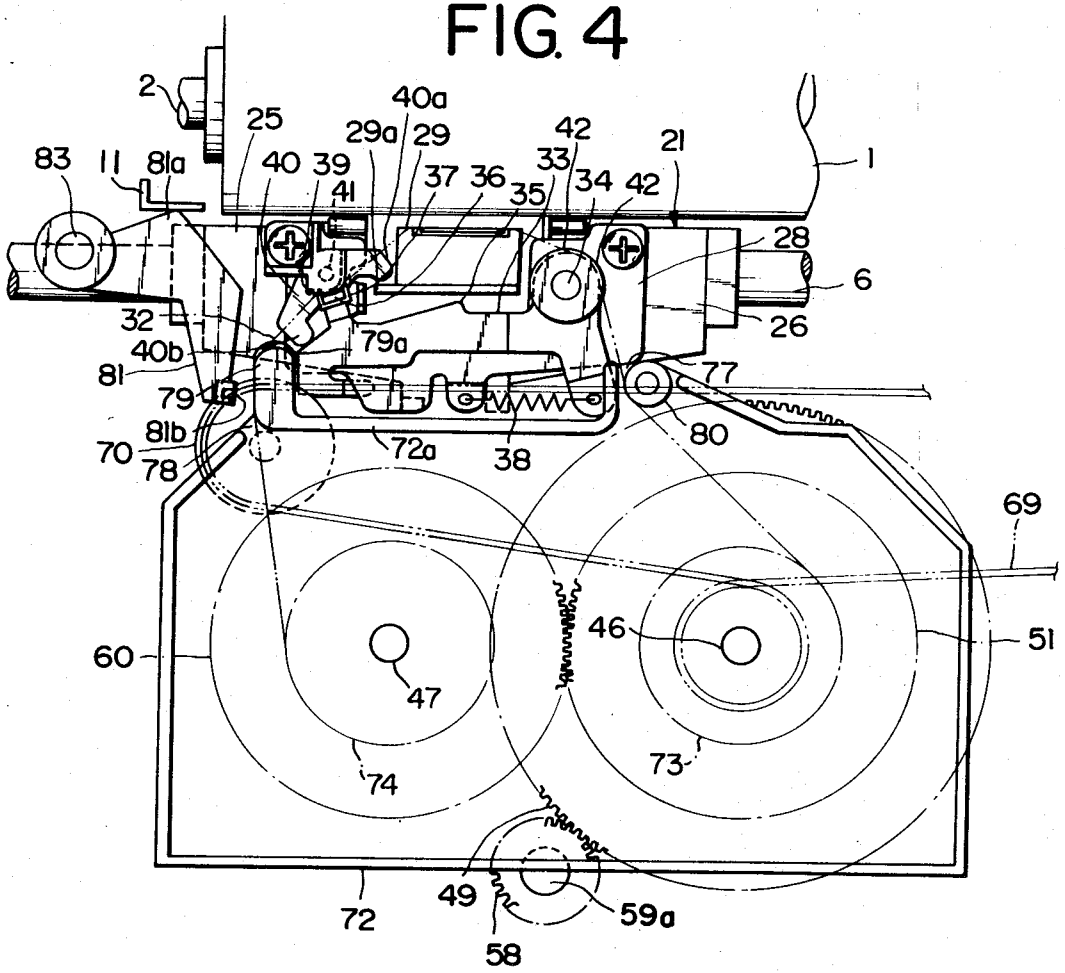
FIG. 4 is a plan view showing an ink ribbon fed through a carrier in a left limit position.

Another lever 40 generally of a triangular shape is mounted at a central portion thereof for pivotal motion on a pin 41 extending between support plate 28 and the guide member 39. A projection 40*a* at the right end of the lever 40 is located adjacent a rear face of a leftward extension 29*a* of the print head 29 and another projection 40*b* at the left end of the lever 40 is located adjacent an oblique rear edge 33*a* of a left end portion of the lever 33. Thus, when the print head 29 is brought into the aforementioned operative position from, for example, the aforementioned first inoperative position, the lever 40 is pressed at the right end projection 40*a* thereof by the extension 29*a* to pivot in a counterclockwise direction about the pin 41 in FIG. 5, whereupon the lever 33 is pushed by the left end projection 40*b* of the lever 40 and is rotated in a counterclockwise direction about the pin 34 in FIG. 5 against the urging of the spring 38, displacing the friction member 37 from the clamping position into a releasing position (FIG. 5) in which the print ribbon 32 is clear of and free from the friction member 37. On the contrary, if the print head 29 is brought out of the operative position, then the lever 33 is permitted to be pivoted clockwise about the pin 34 into the clamping position as seen in FIGS. 4 and 6 by the urging of the spring 38 thereby to pivot the lever 40 clockwise about the pin 41.

A guide roller 42 is also supported for rotation on the pin 34, and a cap 43 is mounted at the top of the pin 34 and of a post 28*a* erected in a left rear portion of the support plate 28.

Figure 3:
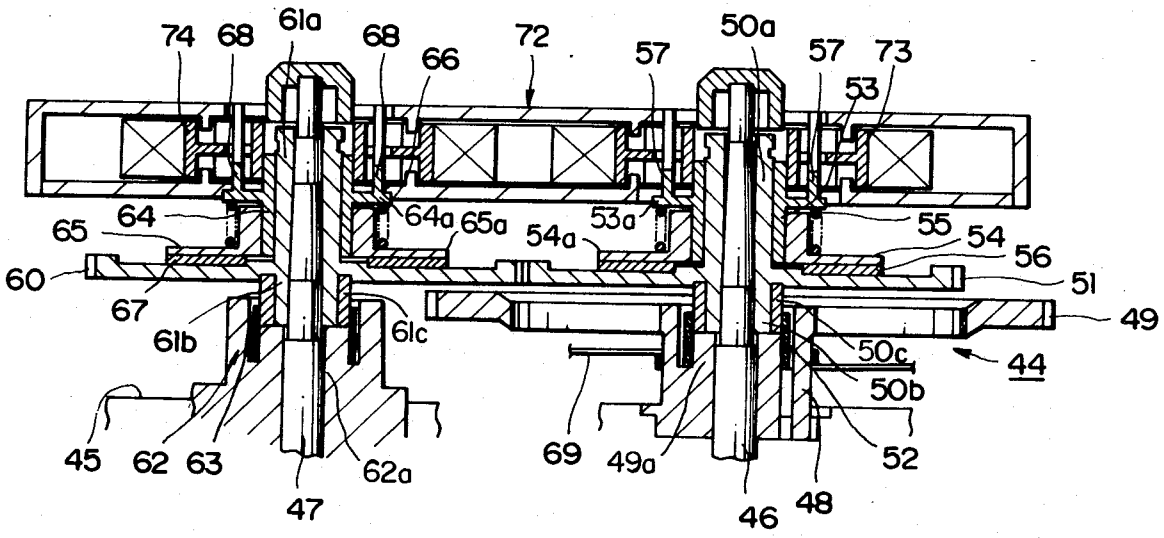
FIG. 3 is a vertical sectional view of a ribbon feed mechanism of the printer of FIG. 1.

Referring now to FIGS. 1 to 3, a ribbon feed mechanism, generally designated at 44, is provided adjacent the left front corner of the printer P. The ribbon feed mechanism 44 includes a pair of shafts 46 and 47 secured to a base plate 45 of the printer frame 3 in a spaced relationship from each other. A gear 49 is rotatably mounted on a lower portion of the shaft 46 and has a wire drum 48 integrally formed therewith. The gear 49 is meshed with a drive gear 58 (see FIG. 4) mounted on an output power shaft 59*a* of a stepping motor 59 which is mounted on the printer frame 3. Another gear 51 is also rotatably mounted on an upper portion of the shaft 46 and has upper and lower cylindrical hubs 50*a* and 50*b* integrally formed therewith. A spring clutch 52 is mounted on and extends over a sleeve member 50*c* secured to the lower hub 50*b* of the gear 51 and an adjacent hublike portion 49*a* of the gear 49, as best shown in FIG. 3. The spring clutch 52 is arranged to transmit clockwise rotation of the gear 49 and counterclockwise rotation of the gear 51 to the gears 51 and 49, respectively, but allows no transmission either of counterclockwise rotation of the gear 49 or of clockwise rotation of the gear 51. Inner and outer flanged wheels 53 and 54 are rotatably mounted on the upper hub 50*a* of the gear 51 and the former is fitted in the latter in a manner of splined coupling (not specifically illustrated) so as to provide for integral rotation and axial displacement relative to each other. The inner wheel 53 has four fingers 57 extending upwardly from the top thereof. An annular friction member 56 made of a hard felt material is interposed between the flange 54*a* of the wheel 54 and the gear 51 and a compression spring 55 is interposed between the flanges 53*a* and 54*a* of the inner and outer wheels 53 and 54 to urge the wheel 53 axially upwardly away from the other wheel 54 and to urge the wheel 54 axially downwardly to press the annular friction member 56 against the gear 51 so as to allow integral rotation between the gear 51 and the wheels 53 and 54.

A gear 60 similar to the gear 51 is rotatably mounted on the shaft 47 and is meshed with the gear 51 so that energization of the motor 59 will rotate the gear 60 through the gears 58 and 49. The gear 60 has cylindrical upper and lower hubs 61*a* and 61*b*. A spring clutch 63 is mounted on and extends over a sleeve member 61*c* secured to the lower hub 61*b* of the gear 60 and a hub-like portion 62*a* of a support 62 secured to the base plate 45. The spring clutch 63 is arranged to allow counterclockwise rotation of the gear 60 but allows no clockwise rotation of the same and hence allows no counterclockwise rotation of the gear 51 meshed with the gear 60. Inner and outer wheels 64 and 65 having flanges 64*a* and 65*a*, similar to the inner and outer wheels 53 and 54, respectively, are mounted rotatably on the upper hub 61*a* of the gear 61 and an annular friction member or wheel 67 is interposed between the gear 60 and the flange 65*a* of the outer wheel 65. A compression spring 66 is interposed between the inner and outer wheels 64 and 65 to urge the wheels 64, 65 axially away from each other thereby to press the annular friction member 67 against the gear 60. The inner wheel 64 has four fingers 68 extending upwardly from the top thereof.

An endless wire or cable 69 is secured at an intermediate portion thereof to the carrier 21 and extends substantially linearly between and around pulleys 70 and 71 which are rotatably mounted adjacent both side walls 4*a*, 4*b* of the printer frame 3, respectively. The wire 69 further extends from the pulleys 70, 71 to the wire drum 48 of the gear 49 around which it is wound in several turns. Thus, when the gear 49 is rotated by energization of the motor 59, the carrier 21 is moved to the right or left across the rod 6.

Referring to FIGS. 3 and 4, as the motor 59 is energized to rotate the gear 58 in the clockwise direction in FIG. 4, the gear 49 is rotated in the counterclockwise direction about the shaft 46 thereby to move the carrier 21 and the print head 29 in the rightward or forward direction. But, this rotation of the gear 49 will not be transmitted to the gear 51 due to the arrangement of the spring clutch 52 as described hereinabove. On the contrary, as the motor 59 is energized to rotate the gear 58 in the counterclockwise direction, the gear 49 is rotated in the clockwise direction thereby to move the carrier 21 and the print head 29 in the leftward or backward direction. The spring clutch 52 now transmits this rotation of the gear 49 to rotate the gear 51 in the same or clockwise direction. The gear 51 in turn rotates the gear 60 in the counterclockwise direction, this rotation of the gear 60 being allowed by the spring clutch 63 as described hereinabove.

Referring now to FIGS. 1 to 4, a ribbon cassette 72 may be mounted in position on the ribbon feed mechanism 44. The ribbon cassette 72 has a supply spool 73 and a takeup spool 74 contained therein. Both spools 73, 74 have axial sectoral holes 75 and 76 formed therein, and when the ribbon cassette 72 is set in position, the fingers 57 and 68 of the inner wheels 53 and 64 extend into the sectoral holes 75, 76 of the spools 73, 74, respectively, as seen from FIG. 3. Accordingly, if the inner wheel 53 or 64 is rotated, the spool 73 or 74 will be rotated thereby. The cassette 72 has openings 77 and 78 formed in a spaced relationship in a rear cassette wall 72*a* (FIG. 4) to allow a print ribbon 32, which may be a thermal ink transfer ribbon, to go out of and come back into the ribbon cassette 72, respectively. A rearwardly projected guide nose 79 is located adjacent the left opening 78 and has a rounded face 79*a* for guiding the print ribbon 32, while a guide roller 80 also for guiding the ribbon 32 is rotatably mounted in the right opening 77. Thus, the print ribbon 32 extends from the supply spool 73, passing the guide roller 80, going out of the cassette 72 from the opening 77, passing the guide roller 42, the print head 29 then the rounded face 79*a* of the guide nose 79 of the cassette 72, coming into the cassette 72 through the opening 78, to the takeup spool 74, as seen from FIG. 4.

The ribbon cassette 72 is constructed and located such that, when the carrier 21 is in the allowable leftmost limit position, the carrier 21 extends within a lateral range defined by the two openings 77 and 78 of the ribbon cassette 72 in order to facilitate replacement of the ribbon cassette 72 with another replacement ribbon cassette 72, as described hereinafter.

A lever 81 is pivotally mounted on an upright pin 83 secured to the side wall 4*a* and is urged to pivot in a counterclockwise direction about the pin 83 by a tension spring 84 (FIG. 1). Thus, when the print head 29 is in the operative position and hence the lug 11 of the operating bail 5 is in the rearmost position, the lever 81 is abutted at an end face 81*b* thereof by a flat side face 79*b* of the rearwardly projecting guide nose 79 of the ribbon cassette 72 to clamp the print ribbon 32 therebetween (this position of the lever 81 will be hereinafter referred to as a "clamping position"). But, if the operating bail 5 is pivoted to bring the print head 29 to the first inoperative position from the operative position, then the lug 11 of the operating bail 5 will be engaged to push the lever 81 to pivot clockwise against the urging of the spring 84 to a position in which the end face 81*b* thereof is spaced from the flat side face 79*b* of the guide nose 79 of the ribbon cassette 72, as seen in FIG. 4. If the operating bail 5 is further pivoted to bring the print head 29 to the second inoperative position, then the lever 81 will be further pivoted to provide a greater distance between the end face 81*b* of the lever 81 and the flat side face 79*b* of the guide nose 79 of the ribbon cassette 72, as seen in FIG. 6 (the last two positions of the lever 81 will be hereinafter referred to as a first releasing position and a second releasing position, respectively).

Figure 5:
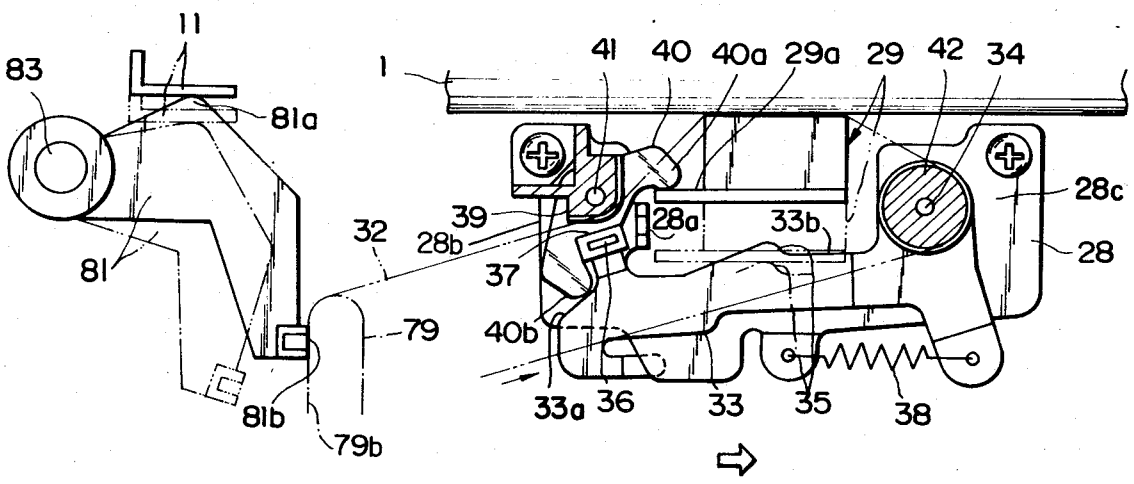
FIGS. 5 and 6 are rather enlarged plan views, in diagrammatic representation, showing an ink ribbon and a print head in different positions.
Figure 6:
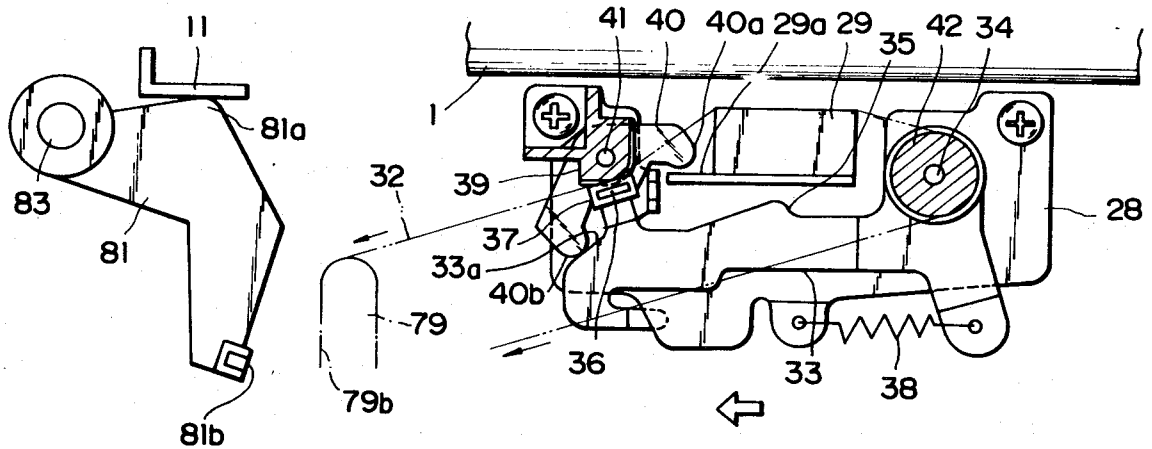

When a new ribbon cassette 72 is to be set in position, e.g., in place of an old or used up ribbon cassette 72, the carrier 21 may be brought to the leftmost limit position as seen in FIG. 4 and the lever 18 will be manually pivoted to its rearmost position to bring the print head 29 and hence the lever 33 to the second inoperative position and the second releasing position to bring the lever 81 to its second releasing position, as seen from phantom in FIG. 5, respectively. Then, in this position, after removal of the old cassette 72 which may have been on the ribbon feed mechanism 44, a new ribbon cassette 72 will be placed in position and a portion of a print ribbon 32 outside the cassette 72 may be threaded to pass around the roller 42, between the print head 29 and the platen 1, between the the friction member 37 and the guide member 39, and between the end face 81*b* of the lever 81 and the guide nose 79 of the ribbon cassette 72. In this position, the lever 18 will now be pivoted to its forwardmost position. As a result, the print head 29 will be brought to its operative position to hold a portion of the ribbon 32 against a medium (not shown) on the platen 1 and hence the lever 33 will be brought to its first releasing position while the lever 81 will be brought to its clamping position thereby to clamp another portion of the ribbon 32 between the end face 81*b* thereof and the flat side face 79*b* of the guide nose 79 of the ribbon cassette 72, as shown in full lines in FIG. 5, to allow subsequent printing operation by the print head 29. However, it is to be noted that, if a latching solenoid (not shown) is advantageously employed alternatively for the solenoid 14, then the print head 29 may be arrested in the first inoperative position when the solenoid 14 is not energized, as shown in full lines in FIG. 4.

When a character or symbol is to be printed, the stepping motor 59 is energized to advance the carrier 21 by increments corresponding in number to columns constituting each or the one character, and at each incremental position, heating elements (not shown) arranged in a column on the print head 29 are selectively energized to allow dot images of ink to be transferred to the medium or paper (not shown) on the platen 1 from the ribbon 32, as well known to those skilled in the art. During such movement of the carrier 21, the ribbon 32 is clamped by and between the end face 81*b* of the lever 81 and flat side face 79*b* of the guide nose 79 of the ribbon cassette 72, and hence, as the carrier 21 advances, a tensile force is applied to the ribbon 32 to urge it to unwind from and rotate the supply spool 73 in the counterclockwise direction in FIG. 4. Thereupon, the urging force acts to rotate the wheels 53 and 54 and the gear 51 in the counterclockwise direction, but since the gear 51 is held from counterclockwise rotation due to the arrangement of the spring clutch 63, only the wheels 53 and 54 are allowed to be rotated clockwise together with the supply spool 73 by the urging force due to a slip between the outer wheel 54 and the friction member 56. As a result, when the carrier 21 advances in the rightward direction for printing a character, the print ribbon 32 is unwound and supplied from the supply spool 73 by an extent corresponding to (that is, substantially twice of) a distance over which the carrier 21 moves.

On the other hand, when the carrier 21 advances rightwardly while no printing operation is effected, such as in a spacing or a tabbing operation, the solenoid 14 is energized so that the print head 29 and the lever 81 are held in their respective first inoperative positions releasing the print ribbon 32 while the lever 35 takes the clamping position, as seen in FIG. 4. Thus, during such movement of the carrier 21, the print ribbon 32 is clamped at a portion thereof by and between the lever 33 and the guide member 39, and hence a tensile force is applied to the ribbon 32 to unwind the ribbon 32 from the supply spool 73 and also from the takeup spool 74. As a result, the ribbon 32 is allowed to be supplied, on one hand, from the supply spool 73 in a similar manner as described above, but by an extent substantially equal to a distance over which the carrier 21 advances since here the print ribbon 32 is clamped on the carrier 21. On the other hand, the tensile force to unwind the ribbon 32 from the takeup spool 74 urges the spool 74 and hence the wheels 64 and 65 as well as the gear 60 in the clockwise direction about the shaft 62. Since the gear 60 is held from clockwise rotation by the arrangement of the spring clutch 63, only the takeup spool 74 and the wheels 64 and 65 are allowed to rotate in the clockwise direction due to the arrangement of the friction member 67, thereby discharging the ribbon 32 from the spool 74 substantially by the aforementioned extent, In this way, during movement of the carrier 21 without printing operation, the print ribbon 32 is not moved or fed relative to the print head 29, thereby decreasing consumption of or saving the print ribbon 32.

Also during returning movement of the carrier 21 in the leftward direction, the solenoid 14 is energized to position the print head 29 and the lever 81 in the respective first inoperative positions and the lever 33 in the clamping position, as seen in FIG. 6. But now, the motor 59 is energized to rotate the gear 49 in the reverse or clockwise direction in FIG. 4. Thus, as the carrier 21 moves backwards, the supply spool 73 is rotated clockwise to take up the ribbon 32 thereon correspondingly. On the other hand, clockwise rotation of the gear 51 rotates the gear 60 and as a result the takeup spool 74 is rotated in the counterclockwise direction to take up the ribbon 32 thereon.

Whether the print ribbon 32 is supplied from or taken up onto any of the supply and takeup spools 73 and 74, the gear 51 and/or the gear 60 are rotated a sufficient amount to take up the ribbon 32 by an extent much greater than a distance of movement of the carrier 29, but the arrangement of the frictional members 56 and 67 allows the ribbon 32 to be taken up only by a required distance, keeping the ribbon 32 taut between the carrier 21 and the ribbon cassette 72.

It is to be understood that the abovedescribed embodiment is merely illustrative of the invention. Numerous other arrangements may be derived by those skilled in the art without departing from the spirit and scope of the invention. For example, while in the embodiment described above the gear 49 which is connected to the motor 59 and has the wire drum 48 for the carrier indexing wire 69 is mounted in coaxial relationship with the supply spool 73 and the wheels 53 and 54, the gear 49 may otherwise be mounted in coaxial relationship with the takeup spool 74 and the wheels 64 and 65. In this modification, the direction of rotation of the motor 59 and the winding direction of the wire 69 will be reversed and the spring clutch 52 will cooperate with a portion of the stationary section 45 of the machine. It is thus contemplated that all such variations and modifications are to be construed in accordance with the following claims.

What is claimed is:

1. In a printer having a stationary section, a platen on said stationary section, a bidirectional drive means on said stationary section, a carrier operatively connected to said drive means for back and forth translatory movement thereby to and from a left margin position along said platen, a print head mounted for translatory movement together with said carrier, and a ribbon feed mechanism including a supply spool and a takeup spool for feeding a print ribbon past said print head, the improvement wherein said ribbon feed mechanism comprises:

first clamp means mounted on said stationary section and selectively operable between an operative position in which said first clamp means clamps a first portion of the print ribbon between said print head and said takeup spool and an inoperative position in which said first clamp means clamps no portion of the print ribbon;

second clamp means mounted on said carrier and selectively operable between an operative position in which said second clamp means clamps another portion of the print ribbon between said supply spool and said first portion of the print ribbon and an inoperative position in which said second clamp means clamps no portion of the ribbon;

means for selectively actuating said first and second clamp means and operable throughout the range of back and forth translatory movement of the carrier between a first actuating position in which said first clamp means and said second clamp means are actuated to respective operative and inoperative positions and a second actuating position in which said first and second clamp means are actuated to respective inoperative and operative positions;

first ribbon driving means disposed for rotation about a first axis fixed relative to said stationary section and operatively connected to said drive means for impositively driving said supply spool to wind the print ribbon onto said supply spool when said drive means operates to move said carrier toward said left margin position and for unwinding the print ribbon therefrom when said drive means operates to move said carrier away from said left margin position; and second ribbon driving means disposed for rotation about a second axis fixed relative to said stationary section and operatively connected to said drive means for impositively driving said takeup spool to wind the print ribbon onto said takeup spool when said drive means operates to move said carrier toward said left margin position and for unwinding the print ribbon therefrom when said drive means operates to move said carrier away from said left margin position.

2. A printer as claimed in claim 1, wherein said first ribbon driving means includes a friction coupling having a first rotatable member and a second rotatable member on which said supply spool is supported, said first and second rotatable members being disposed in frictional engagement with each other, and a one-way clutch disposed between said drive means and said first rotatable member of said friction coupling.

3. A printer as claimed in claim 2, wherein said second ribbon driving means includes a friction coupling having a first rotatable element operatively connected to said drive means and a second rotatable element on which said takeup spool is supported, said first and second rotatable elements being disposed in frictional engagement with each other, and a one-way clutch disposed between said first rotatable element and said stationary section, said one-way clutch of the second ribbon driving means operative to hold said first rotatable element against rotation in a direction that unwinds the print ribbon from said take-up spool.

4. A printer as claimed in claim 3, wherein said second rotatable element of said second ribbon driving means includes a first part on which said takeup spool is supported, a second part mounted for integral rotation on and axial movement relative to said first part, and a compression spring interposed between said first and second parts for urging said second part into frictional engagement with said first rotatable element of said second driving means.

5. A printer as claimed in claim 2, wherein said one-way clutch is a spring clutch.

6. A printer as claimed in claim 3, wherein said one-way clutch of the second ribbon driving means is a spring clutch.

7. A printer as claimed in claim 1, wherein said first ribbon driving means includes a stepping motor, a first gear mounted on an output shaft of said motor, a second gear mounted for rotation about said first axis and meshed with said first gear, said second gear having a drum portion thereon, and a substantially endless cable or wire connected to said carrier and partially wound on said drum portion of said second gear so as to move said carrier when said motor is energized.

8. A printer as claimed in claim 1, wherein said print head is disposed for pivotal motion about a horizontal axis extending in parallel with said platen between an operative position in which said print head is pressed against said platen and a first inoperative position in which said print head is spaced from said platen, said print head coupled to said means for actuating said first and second clamp means, said actuating means pivoting said print head to the print head operative position when actuated to said first actuating position and said actuating means pivoting said print head to the first print head inoperative position when actuated to said second actuating position.

9. A printer as claimed in claim 8, wherein said first clamp means comprises a pivotal lever having a first clamping face thereon, and stationary means defining another clamping face cooperable with said first clamping face of said pivotal lever for clamping the print ribbon therebetween.

10. A printer as claimed in claim 8, wherein said second clamp means includes a fixed member mounted on said carrier, a first lever mounted for pivotal motion between an operative position in which said first lever cooperates with said fixed member to clamp a portion of the print ribbon therebetween and an operative position spaced from said fixed member, a spring urging said first lever into said operative position thereof, and a second lever pivotally mounted on said carrier adjacent said fixed member and disposed such that when said print head is in said operative position thereof, said second lever allows said first lever to be in said operative position thereof under the urging of said spring, but when said print head is in said first inoperative position thereof, said second lever is engaged with said print head and said first lever to hold said first lever in said inoperative position against the urging of said spring.

11. A printer as claimed in caim 10, wherein said print head is further movable to a second print head inoperative position which is spaced further from said platen than said first print head inoperative position, and said first lever of said second clamp means is disposed to be engaged, when said print head is moved to said second print head inoperative position, by said print head and brought to said second print head inoperative position, thereby allowing threading of a print ribbon through said first and second clamp means.

12. A printer as claimed in claim 11, wherein said means for actuating includes a manually operable lever for selectively positioning said print head to said operative and first and second inoperative print head positions.

13. A printer as claimed in claim 8, wherein said means for actuating includes a bail mounted for pivotal motion about said horizontal axis and operatively associated with said print head to move said print head between said print head operative and first print head inoperative positions, means for urging said bail to move said print head to said print head operative position, and electromagnetic means connected to said bail and energizable to bring and hold said print head to said first print head inoperative position against the urging of the urging means.

14. A printer as claimed in claim 1, wherein said first and second axes of said first and second ribbon driving means are located adjacent each other and one of said first and second ribbon driving means is operatively connected to said drive means by way of the other of said first and second ribbon driving means.

15. A printer as claimed in claim 14, wherein said ribbon feed mechanism further comprises a ribbon cassette in which said supply and takeup spools are contained, and means on said stationary section for supporting said ribbon cassette in position relative to said first and second ribbon driving means, said ribbon cassette having a face thereon which cooperates with a movable member of said first clamp means to clamp a portion of the print ribbon therebetween.

16. In a printer having a stationary section, a platen on said stationary section, a bidirectional carrier drive means on said stationary section, a carrier operatively connected to said drive means for back and forth translatory movement thereby to and from a left margin position along said platen, a print head mounted for translatory movement together with said carrier, and a ribbon feed mechanism including a supply spool and a takeup spool for feeding a print ribbon past said print head, the improvement wherein said ribbon feed mechanism comprises:

first clamp means mounted on said stationary section and having opposed first clamp surfaces selectively actuatable between a clamped position in which said opposed first clamp surfaces are resiliently biased together to clamp a first portion of the print ribbon therebetween and a released position in which said opposed surfaces are spaced apart from one another to unclamp the print ribbon therebetween;

second clamp means connected to said carrier and having opposed second clamp surfaces selectively actuatable between a clamping position in which said opposed second clamp surfaces are resiliently biased together to clamp another portion of the print ribbon between said supply spool and said first portion of the print ribbon and a released position in which said opposed second clamp surfaces are spaced apart from one another to unclamp the print ribbon therebetween; and means for selectively actuating said first and second clamp means and operable throughout the range of back and forth translatory movement of the carrier between a first actuating position in which said first clamp means and said second clamp means are actuated to respective clamped and released positions or a second actuating position in which said first and second clamp means are actuated to respective released and clamped positions.

17. The printer as claimed in claim 16, wherein said print head is movably mounted on said carrier for movement between a printing position in which said print head is biased against said platen and non-printing position in which said print head is spaced away from said platen, said print head connected to said means for actuating and moved thereby to said printing position when said means for actuating is in said first actuating position and moved thereby to said non-printing position when said means for actuating is in said second actuating position.

18. The printer of claim 17 wherein said means for selectively actuating further comprises:

an electromagnetic actuator selectively operable for operating said means for actuating between the first and second actuating positions.

19. The printer of claim 17 further comprising:

first ribbon driving means disposed for rotation about a first axis fixed relative to said stationary section and operatively connected to said carrier drive means for impositively driving said supply spool to wind the print ribbon onto said supply spool when said carrier drive means operates to move said carrier toward said left margin position and for unwinding the print ribbon therefrom when said carrier drive means operates to move said carrier away from said left margin position; and second ribbon driving means disposed for rotation about a second axis fixed relative to said stationary section and operatively connected to said carrier drive means for impositively driving said takeup spool to wind the print ribbon onto said takeup spool when said carrier drive means operates to move said carrier toward said left margin position and for allowing said takeup spool to unwind the print ribbon therefrom when said carrier drive means operates to move said carrier away from said left margin position.

* * * * *